United States Patent [19]

Nowack et al.

[11] 4,421,638

[45] Dec. 20, 1983

[54] DEMETALLIZATION OF HEAVY OILS

[75] Inventors: Marvin M. Johnson, Gerhard P. Nowack; all of Bartlesville, Okla.

[73] Assignee: Phillips Petroleum Company, Bartlesville, Okla.

[21] Appl. No.: 481,085

[22] Filed: Mar. 31, 1983

[51] Int. Cl.[3] ..... C10G 29/02

[52] U.S. Cl. ..... 208/251 R; 208/251 H; 208/249

[58] Field of Search ..... 208/251 R, 251 H, 249, 208/292, 295

[56] References Cited

U.S. PATENT DOCUMENTS 3,144,415 8/1964 Silverman ..... 252/437

3,647,677 3/1972 Wolff et al. ..... 208/48

FOREIGN PATENT DOCUMENTS 446036 1/1948 Canada ..... 208/179

*Primary Examiner*—Patrick Garvin

*Assistant Examiner*—Anthony McFarlane

[57] ABSTRACT

An improved process for removing metals from heavy oils and other hydrocarbon feed streams is disclosed. The process includes adding phosphorus sulfide to the hydrocarbon feed stream under suitable demetallizing conditions. It is believed that phosphorus sulfide reacts with the metals contained in the hydrocarbon containing feed stream to form oil insoluble compounds that can be removed from the hydrocarbon containing feed stream by any conventional method, such as filtration, centrifugation, or decantation.

10 Claims, No Drawings

DEMETALLIZATION OF HEAVY OILS

This invention relates to an improved process for removing metals from heavy oils and other hydrocarbons containing feed streams.

It is well known that heavy crude oils, as well as products from extraction and/or liquifaction of coal and lignite, products from tar sands, products from shale oil and similar products may contain metals such as vanadium and nickel. The presence of the metals make further processing of heavier fractions difficult since the metals generally act as poisons for catalysts employed in processes such as catalytic cracking, hydrogenation or hydrodesulfurization.

It is thus an object of this invention to provide a process for removing metals from a hydrocarbon containing feed stream so as to improve the processability of such hydrocarbon containing feed stream and especially improve the processability of heavy crude oils, such as Monagas heavy crude.

In accordance with the present invention, phosphorus sulfides, selected from at least one of $P_2S_5$ and $P_4S_3$, are mixed with a hydrocarbon containing feed stream, which contains metals, under suitable demetallization conditions. It is believed that the phosphorus sulfides react with metals contained in the hydrocarbon containing feed stream to form oil insoluble compounds that can be removed from the hydrocarbon containing feed stream by any conventional method such as filtration, centrifugation or decantation. Removal of the metals from the hydrocarbon containing feed stream in this manner provides for improved processability of the hydrocarbon containing feed stream in processes such as catalytic cracking, hydrogenation and hydrodesulfurization.

Other objects and advantages of the invention will be apparent from the foregoing brief description of the invention and the appended claims as well as the detailed description of the invention which follows.

Any metal which will react with phosphorus sulfides to form an oil insoluble compound can be removed from a hydrocarbon feed stream in accordance with the present invention. The present invention is particularly applicable to the removal of vanadium and nickel.

Metals can be removed from any suitable hydrocarbon containing feed streams. Suitable hydrocarbon containing feed streams include petroleum products, coal pyrolyzates, products from extraction and/or liquifaction of coal and lignite, products from tar sands, products from shale oil and similar products. Suitable hydrocarbon feed streams include gas oil having a boiling range from about 205° C. to about 538° C., topped crude having a boiling range in excess of about 343° C. and residuum. However, the present invention is particularly directed to heavy feed streams such as heavy crude oils and other materials which are generally regarded as being too heavy to be distilled. These materials will generally contain the highest concentrations of metals such as vanadium and nickel.

The process of this invention can be carried out by means of any apparatus whereby there is achieved a mixing of phosphorus sulfides with the hydrocarbon containing feed stream. The process is in no way limited to the use of a particular apparatus. The process can be carried out as a continuous process or as a batch process. The term hydrocarbon containing feed stream is used herein to refer to both a continuous and batch process although the hydrocarbon containing fluid will generally not be flowing in a batch process.

Any suitable amount of phosphorus sulfide can be added to the hydrocarbon containing feed stream. The amount of phosphorus sulfide added to the hydrocarbon containing feed stream will range from a minimal demetallizing amount to a maximum amount, based on the cost of such an addition. Significant improvement in demetallization occurs with at least about 0.5 weight percent, based on the weight of the hydrocarbon containing feed stream. Preferably, the concentration of phosphorus sulfide will be in the range of about 0.5 to about 10 weight percent based on the weight of the hydrocarbon containing feed stream. The excess phosphorus sulfide can be thermally decomposed which will generally result in its conversion to an insoluble form which can be removed from the hydrocarbon containing feed stock when the metals are removed.

Any suitable reaction time between the phosphorus sulfide and the hydrocarbon containing feed stream can be utilized. In general, the reaction time can range from a minimal time necessary to demetallize the hydrocarbon containing feed stream, to a maximum, economically feasible time to completely demetallize the hydrocarbon containing feed stream. Preferably, the reaction time will range from about 0.1 to about 10 hours. Thus, for a continuous process, the flow rate of the hydrocarbon feed stream mixed with phosphorus sulfide should be such that the time required for the passage of the mixture through the reactor (residence time) will preferably be in the range of about 0.1 to about 10 hours. This generally requires a liquid hourly space velocity in the range of about 0.1 to about 10 cc of oil per cc of catalyst per hour. For a batch process, the mixture should simply remain in the reactor under reaction conditions for a time preferably in the range of about 0.1 to about 10 hours (again generally referred to as residence time).

The demetallization process of the present invention can be carried out at any suitable temperature. The temperature will generally range from a minimal demetallizing temperature to any economically practical temperature. Preferably, the temperature will be in the range of about 300° to about 450° C. Higher temperatures do improve the removal of metals but temperatures should not be utilized which will have adverse effects on the hydrocarbon containing feed stream. Lower temperatures can generally be used for lighter feeds.

A gas can also be present during the mixing of the hydrocarbon containing feed stream and the phosphorus sulfide. The gas allows high pressure operation to be achieved. Gases such as hydrogen, which is the most preferred gas, provide other desirable effects such as reduced coking. Other inert gases such as nitrogen, methane and carbon dioxide can be utilized but these gases are less desirable since they in general do not provide the desirable effects that hydrogen provides.

Any suitable pressure can be utilized in the demetallization process. When a non-oxygen containing gas is utilized, the reaction pressure can range from about atmospheric to any economically practical high pressure. Preferably, the pressure will be in the range of about 100 to about 2500 psig. Higher pressures tend to reduce coke formation but operations at high pressure can have adverse economic consequences.

Special solvents are not required for the addition of phosphorus sulfide to the hydrocarbon containing feed stream being treated. If the phosphorus sulfide used is gaseous or liquid, the phosphorus compounds can be pumped in that form into the hydrocarbon containing feed stream. If the phosphorus sulfide is solid, the phosphorus sulfide can be dissolved in the hydrocarbon containing feed stream.

As has been previously stated, it is believed that phosphorus sulfide reacts with metals contained in the heavy oil to form oil insoluble substances. These oil insoluble substances can be removed from the hydrocarbon containing feed stream by any suitable method. Filtration is presently preferred but other methods such as centrifugation and decantation can be utilized if desired.

If the demetalization process of the present invention is used in a refinery where hydrodesulfurization is practiced, it is preferred to employ the demetalization process after the hydrodesulfurization step since the phosphorus compounds can interfere with hydrodesulfurization. The fact that the feedstream has been passed through a hydrodesulfurization process does not affect the demetalization process of the present invention.

The following example is presented in further illustration of the invention.

EXAMPLE I

The demetallization of a Monagas (Venezuela) pipeline oil was carried out as a batch process in a stirred autoclave reactor. Monagas pipeline oil is a Monagas heavy crude that is diluted with a few percent of a fuel oil to reduce its viscosity so that it can be transported in pipelines. This pipeline oil contained about 408 parts per million vanadium and about 99 parts per million of nickel.

A stirred autoclave was charged with about 110 grams of pipeline oil and (when used) variable amounts of phosphorus sulfides as demetallizing agents. The sealed autoclave was heated to a specified temperature during a time period of about 1 hour and then held at that temperature for about 30 minutes, while the reactor contents were stirred at a rate of about 1000 rpm.

After cooling, the mixture in the autoclave was filtered through a fritted glass filter and analyzed for nickel and vanadium by atomic absorption spectrometry and plasma emission spectrometry, respectively. Process conditions and results are summarized in Table I. In all runs the gas above the reaction mixture in the autoclave was air.

TABLE I

| Run | Demetal. Agent | Weight-% of Agent | Temp. (°C.) | Initial Pressure (psig) | Reaction Time (min) | %-Removal of Ni | %-Removal of V |
|---|---|---|---|---|---|---|---|
| 1 (Control) | — | 0 | 400 | 0 | 30 | 12 | 17 |
| 2 (Control) | $P_4S_3$[1] | 0.06 | 400 | 0 | 30 | 21 | 18 |
| 3 (Control) | $P_4S_3$[1] | 0.1 | 398 | 0 | 30 | 17 | 12 |
| 4 (Control) | $P_4S_3$[1] | 0.2 | 400 | 0 | 30 | 20 | 20 |
| 5 (Invention) | $P_4S_3$[1] | 0.5 | 398 | 0 | 30 | 16 | 76 |
| 6 (Invention) | $P_4S_3$[1] | 1.2 | 398 | 0 | 30 | 63 | 85 |
| 7 (Invention) | $P_2S_5$[2] | 1.2 | 398 | 0 | 30 | 46 | 83 |
| 8 (Invention) | $P_4S_3$[1] | 2.8 | 398 | 0 | 30 | 49 | 92 |
| 9 (Invention) | $P_4S_3$[1] | 3.4 | 400 | 0 | 30 | 16 | 90 |
| 10 (Invention) | $P_4S_3$[1] | 3.2 | 417 | 0 | 30 | 90 | 99.7 |
| 11 (Control) | $P_4S_3$[1] | 0 | 417 | 0 | 60 | 75 | 78 |

[1]Lot 3214A, ICN pharmaceutical, Inc., Plainview, N.Y.
[2]technical grade, lot 785659, Fisher Scientific Co., Pittsburgh, Pa.

Data in Table I show that heating of heavy oil with phosphorus sulfides at levels of less than about 0.5 weight-% (Runs 2, 3, 4) was not more effective in remvoing metals, particularly vanadium, than heat treatment without phosphorus sulfides (Run 1). Amounts of about 0.5 to >3.0 weight percent of $P_4S_3$ and $P_2S_5$ were quite effective in removing vanadium from oil at about 400°–420° C. even though these compounds did not remove a substantial amount of nickel. The API (60° F.) gravity of the product generally ranged from about 14 to about 16; its phosphorus content generally ranged from about 100 to about 8000 ppm.

We claim:

1. A method for treating metal containing hydrocarbon feed streams comprising contacting said hydrocarbon feed stream with an amount of a phosphorus sulfide of at least about 0.5 weight percent based on the weight of the hydrocarbon containing feed stream at demetallizing temperatures and pressures sufficient to convert said metals to oil insoluble compounds.

2. A method as defined in claim 1 where said phosphorus sulfide is at least one of $P_2S_5$ and $P_4S_3$.

3. A method as defined in claim 1 where said hydrocarbon feed stream is selected from of crude oil, topped crude, residuum and heavy oil extracts.

4. A method as defined in claim 1 where said metals are selected from at least one of vanadium and nickel.

5. A method as defined in claim 1 wherein the amount of phosphorus sulfide contacted with said hydrocarbon feed stream is in the range of about 0.5 to about 10 weight percent based on the weight of said hydrocarbon containing feed stream.

6. A method for removing metal contained in hydrocarbon feed streams comprising contacting said hydrocarbon feed stream with an amount of phosphorus sulfide of at least about 0.5 weight percent at a temperature in the range of about 300° C. to about 450° C., for a time in the range of about 0.1 hours to about 2 hours, at a pressure in the range of about 100 psig to about 2500 psig, to convert said metal to oil insoluble compounds; and removing said oil insoluble compounds from said hydrocarbon feed stream.

7. A method as defined in claim 6 where said phosphorus sulfide is selected from at least one of $P_2S_5$ and $P_4S_3$.

8. A method as defined in claim 6 where said hydrocarbon feed stream is selected from crude oil, topped crude, residuum and heavy oil extracts.

9. A method as defined in claim 6 where said metals are selected from at least one of vanadium and nickel.

10. A method as defined in claim 6 wherein the amount of phosphorus sulfide contacted with said hydrocarbon feed stream is in the range of about 0.5 to about 10 weight percent based on the weight of the said hydrocarbon containing feed stream.

* * * * *

UNITED STATES PATENT AND TRADEMARK OFFICE

CERTIFICATE OF CORRECTION

PATENT NO. : 4,421,638

DATED : December 20, 1983

INVENTOR(S) : Kukes et al

It is certified that error appears in the above-identified patent and that said Letters Patent is hereby corrected as shown below:

Should read Kukes et al rather than Nowack et al on title page under item [19]

Item [75] Inventors: On title page should read:

-- [75] Inventors: Simon G. Kukes, Marvin M. Johnson, Gerhard P. Nowack; all of Bartlesville, Okla --

Signed and Sealed this

Eighteenth Day of September 1984

[SEAL]

*Attest:*

GERALD J. MOSSINGHOFF

*Attesting Officer*

*Commissioner of Patents and Trademarks*